United States Patent [19]

McCabe

[11] Patent Number: 4,641,728

[45] Date of Patent: Feb. 10, 1987

[54] SCAFFOLD SYSTEM

[76] Inventor: Raymond T. McCabe, R.F.D. 2, Inlet Oaks, Delavan, Wis. 53115

[21] Appl. No.: 714,911

[22] Filed: Mar. 22, 1985

[51] Int. Cl.[4] ..... E04G 1/20

[52] U.S. Cl. ..... 182/146; 182/132; 248/408; 248/167

[58] Field of Search ..... 182/145, 141, 148, 199, 182/184, 146, 132; 248/167, 407–408

[56] References Cited

U.S. PATENT DOCUMENTS

| | | | |
|---|---|---|---|
| 2,806,670 | 9/1957 | Straster | 248/167 |
| 2,921,763 | 1/1960 | Miller | 248/167 |
| 3,169,604 | 2/1965 | Pranger | 248/146 |
| 3,314,553 | 4/1967 | Vircks | 248/167 |
| 3,318,414 | 5/1967 | Meek | 182/146 |
| 3,323,616 | 6/1967 | Best | 182/146 |
| 3,438,460 | 4/1969 | Solari | 182/146 |
| 3,612,219 | 10/1971 | Fortner | 182/146 |
| 4,113,221 | 9/1978 | Wehner | 248/408 |

FOREIGN PATENT DOCUMENTS

| | | | |
|---|---|---|---|
| 158451 | 4/1957 | Sweden | 248/408 |

*Primary Examiner*—Reinaldo P. Machado
*Assistant Examiner*—Alvin Chin-Shue
*Attorney, Agent, or Firm*—Fuller, Puerner & Hohenfeldt

[57] ABSTRACT

A scaffold system has self standing towers and brackets that are guided and supported by the towers. The towers include three legged support bases that are collapsible to make the base convenient to store and transport. The brackets includes safety latches that engage the tower in a fail safe manner to stop a bracket that may fall uncontrollably because of other equipment failure. Some of the safety latches may be rendered inoperable as the bracket is raised and lowered under power, but one safety latch remains operable at all times.

8 Claims, 10 Drawing Figures

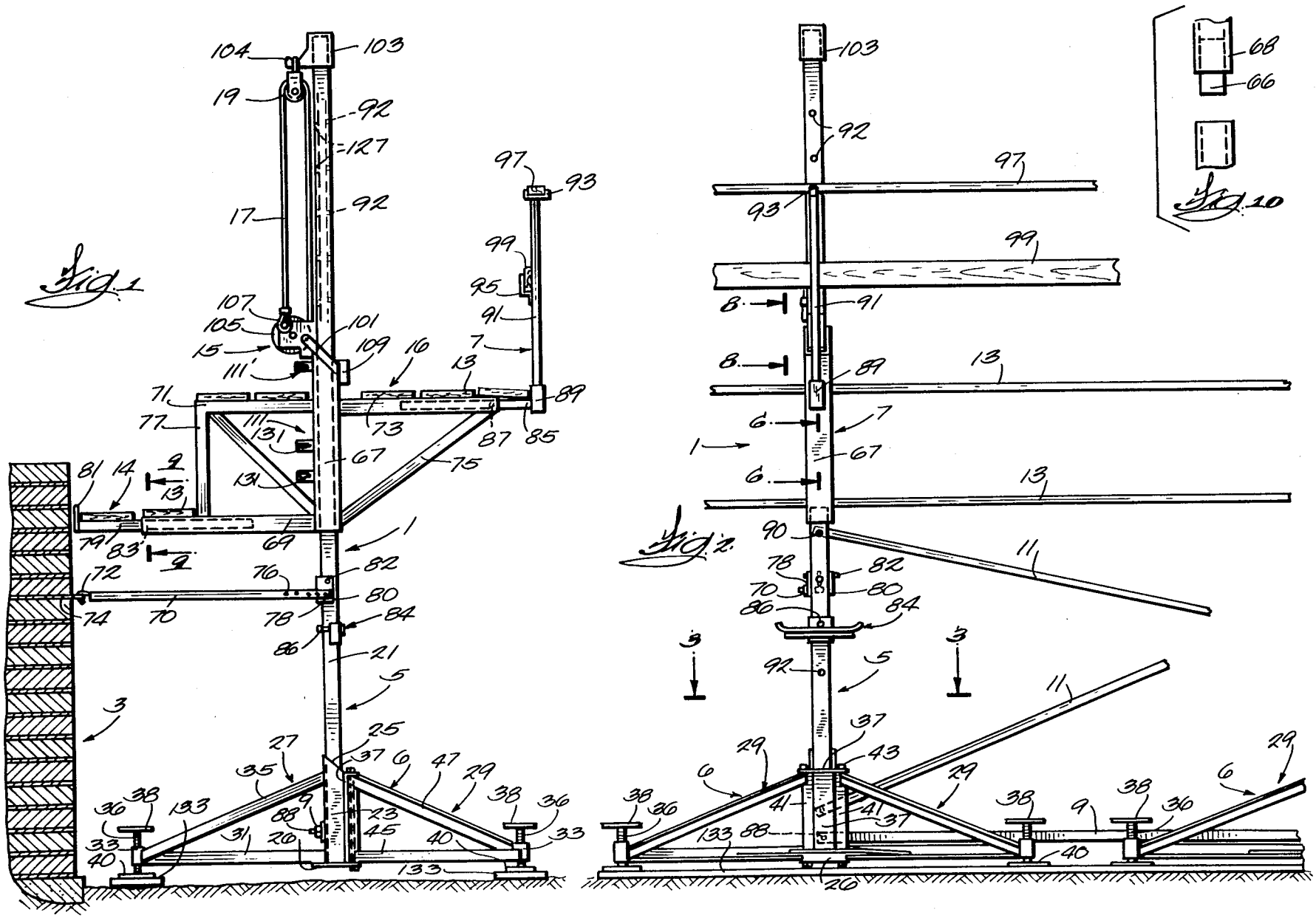

SCAFFOLD SYSTEM

BACKGROUND OF THE INVENTION

1. Field of the Invention

This invention pertains to scaffolds, and more particularly to collapsible scaffolds having vertically adjustable work platforms.

2. Description of the Prior Art

Various equipment has been developed to vertically adjust the height at which workmen perform their tasks. For example, Bulletin MS-55, published by the Morgen Mfg. Co., Yankton, S.D., illustrates tower scaffolding suitable for supporting masons building high walls. While the Morgen scaffolding has enjoyed some success, it possess two deficiencies. The first is that the individual scaffold towers are not self standing because each tower is supported by a base having only two legs. Consequently, a workman or other means is required merely to hold a first tower while additional towers are being erected. Secondly, there is no fail safe safety device for securely locking the platforms to the towers.

U.S. Pat. No. 2,140,617 shows a vertically adjustable scaffold that includes a standard supported by a tripod of three braces, thus making the standard self standing. In one version of the scaffold, the three braces are independently adjustable relative to each other. However, the braces are not collapsible with respect to the standards, thereby rendering the standards bulky and cumbersome to store.

U.S. Pat. No. 3,480,110 illustrates an extendible scaffold having a three legged support base for each upright member. One of the legs is pivotable about the upright member, while the two other legs remain rigidly fastened to the upright member. In the collapsed condition, the pivotable leg remains skewed relative to the fixed base legs, so the support base is awkward to handle and store.

Thus, a need exists for a self standing scaffold with a base that is collapsible for easy storing and transporting and that has a fail safe device for supporting the workers' platform.

SUMMARY OF THE INVENTION

In accordance with the present invention, a fail safe scaffold system is provided that may be quickly and efficiently erected by a single workman. This is accomplished by apparatus that includes a plurality of stand alone towers having collapsible bases that support a platform by means of safety spring latches.

The towers comprise bases having sockets for vertically receiving tower masts. The towers are capable of standing alone because three support legs extend radially from the base sockets. One of the legs is fixed relative to the socket, but the other two legs are swingable in a horizontal plane. In the operative mode, the two swingable legs extend radially from the socket and are connected by cross braces, which rigidly and safely hold the legs in place. In the collapsed mode, the two swingable legs lie parallel to and adjacent the fixed leg, thereby reducing space and making the base convenient to transport and store.

Any number of towers of the present invention may be joined to create a scaffold system of any desired length. Because the towers are self standing, they may be erected individually, and it is not necessary to hold one or more towers in place while waiting for other scaffold components to be erected to support previously assembled towers. The towers are spaced equidistantly by spacing rods and X-braces.

The towers include upstanding masts that guide and support brackets which in turn support the work platforms. The brackets are designed so that the platforms are on two levels, a lower level facing the work to be performed, as, for example, a brick wall to be erected, and an upper level on the opposite side of the masts from the lower platform. The lower platform is designed for the masons building the wall, and the upper platform is designed to store materials needed by the masons. The brackets are raised and lowered on the masts by means of electric winches attached to each bracket. The winch cables pass over a suitable pulley on the top of each mast. The towers of the present invention may be raised to great heights by inserting additional masts into lower ones.

Further in accordance with the present invention, the scaffold system includes fail safe devices for supporting the brackets on the towers. In addition to the support provided by the winch cable and pulley system, each bracket is supported on the corresponding mast by a spring loaded safety latch. Each bracket has three safety latches, which are spaced vertically on the bracket such that no latch is ever more than about two and one-half inches from one of several support holes regularly spaced along the mast. The safety latches include plungers that are spring loaded to enter the mast support holes. To aid the plungers to enter a support hole when the bracket is descending, the mast is fabricated with a tear drop shaped lead-in on the upper side of each hole. Two of the latches on each bracket may be locked for nonengagement with a mast hole during winch operation, but the third latch is not lockable. The third latch must be controlled by the winch operator as he lowers the platform.

Other objects and advantages of the invention will become apparent to those skilled in the art from the disclosure.

BRIEF DESCRIPTION OF THE DRAWINGS

FIG. 1 is a side view of the scaffold system of the present invention;

FIG. 2 is a back view of the scaffold system of the present invention;

FIG. 10 is an enlarged exploded view showing the vertical connection between adjoining masts of a scaffold system tower.

DETAILED DESCRIPTION OF THE INVENTION

Figure 3:
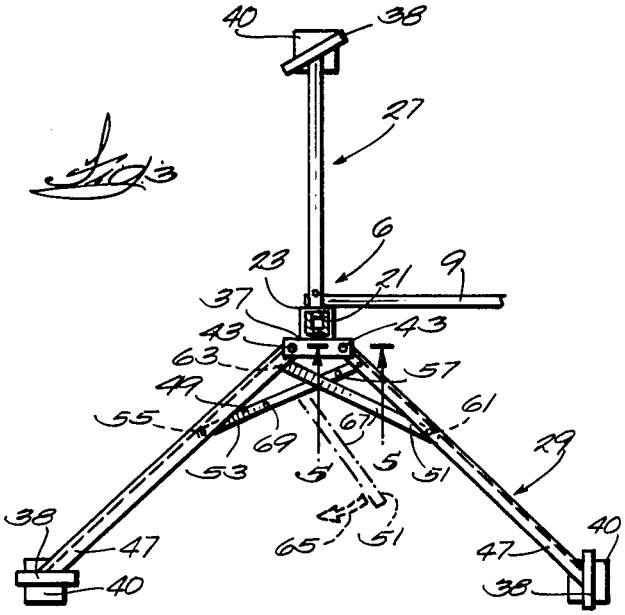
FIG. 3 is a cross sectional view taken along lines 3—3 of FIG. 2.

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Referring to FIGS. 1 and 2, a scaffold system 1 is illustrated that includes the present invention. The scaffold system finds particular usefulness for erection of masonry walls 3, but it will be understood that the invention is not limited to construction applications.

General

The scaffold system 1 includes a plurality of towers 5, each having a base support 6. Each tower 5 guides a bracket 7 for vertical movement thereon. The towers 5 are longitudinally spaced at regular intervals by spacer rods 9 and X-braces 11. Supported by and extending between the brackets 7 are a number of planks 13, so as to create platforms 14 and 16 for workers and material, respectively. The brackets are vertically adjustable by means of electric winches 15 having the cables 17 thereof looped over pulleys 19 supported at the top of the towers. For strength and rigidity, the tower and bracket components are preferably fabricated from structural steel components.

Towers

In accordance with the present invention, each tower 5 comprises an upstanding mast 21 and a three-legged base 6. Preferably, the mast 21 is made of a square tube that is removably received within a square base socket 23. The high strength-to-weight ratio of tubing makes that structural element highly desirable, and square tubing is prefered because relative rotation of the various interfitting components is thereby eliminated. To aid in guiding the mast into the base socket 23, the top surface 25 of the socket is sloped. To the lower end of the socket is welded a plate 26 that prevents the mast from passing through the socket.

The base 6 is manufactured with one fixed leg 27 and a pair of substantially identical swingable legs 29. The fixed leg 27 includes a member 31 welded to the socket 23 and extending radially and generally horizontally therefrom. A threaded collar 33 is welded to the free end of the horizontal member 31. A brace 35 is also welded to the socket and extends at an angle thereto to intersect the horizontal member for welding thereto. The brace 35 may also be welded to the collar 33. The horizontal member may be made from a structural angle and the brace may be a square tube. Threaded into the collar is a leveling screw 36 with an adjustment handle 38 fastened to the upper end thereof. A foot pad 40 is rotatably received on the lower end of the screw 36.

Referring to FIGS. 1, 2, 3, and 5, the swingable legs 29 of the present invention will be described. An upstanding L-shaped member 37 is welded to the socket 23. A pair of square tubes 41 is snugly supported between the top plate 39 of the member 37 and the bottom plate 26. The tubes 41 are retained in place between the plates 39 and 26 by a pivotal connector in the form of conventional screws and nuts 43 and 44, respectively. For convenience, the nuts 44 may be welded to the plate 26. It will be noticed from FIGS. 2, 3, and 4 that the retaining screws 43 lie on either side of an imaginary horizontal extension of the fixed leg 27 through the socket. Welded to each tube 41 is a horizontal member 45 and an angled brace 47, which intersect and are welded together and to a collar 33' in a manner similar to the construction of the fixed leg 27. The collars 33' threadably receive leveling screws 36, together with handles 38 and foot pads 40. Because each leg terminates in a leveling screw, the mast inserted in the socket is adjustable in two planes to a vertical attitude.

Referring to FIGS. 1, 2, and 3, swingable legs 29 are shown in the operative mode. To rigidly and safely hold the swingable legs in place, the present invention includes a pair of rotatable cross braces 49 and 51. Cross brace 49 is fastened at end 53 thereof to the horizontal member 45 of one leg 29 by a removable fastener 55. The second end 57 of the cross brace 49 is pivotally connected to the horizontal member 45 of the second leg 29 by a fixed pin 59. The cross brace 51 is similarly connected by removable fastener 61 and fixed pin 63. With the fasteners and pins 55, 59, 61, and 63 in place, the legs 29, in cooperation with fixed leg 27, rigidly and safely support the tower 5.

To collapse the base 6 according to the present invention, the fasteners 55 and 61 are removed. Cross brace 51 is pivoted about pin 63 as shown by phantom lines 51' and arrow 65, FIG. 3. Cross brace 49 is pivoted in a similar manner. Cross brace 51 is pivoted until fastener 55 may be reinstalled through the fist horizontal member 45 and through opening 67 in cross brace 51, and fastener 61 is reinstalled through opening 69 in cross brace 49. In that situation, the legs 29 are free to swing about the screws 43.

Figure 4:
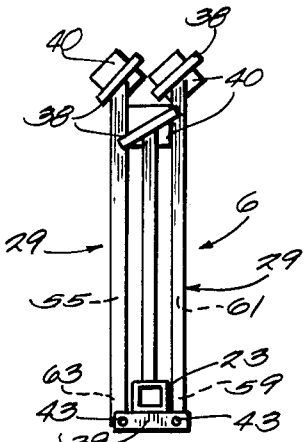
FIG. 4 is a cross sectional view similar to FIG. 3, but showing the legs of the tower base in the collapsed mode.

Referring to FIG. 4, the base is shown in the collapsed mode. (It is anticipated that the base will not be collapsed with the towers in the assembled condition.) The legs 29 may be swung until they are parallel to and adjacent the fixed leg 27. Because of the location of the screws 43, the collapsed folding legs straddle the fixed leg. The swingable legs are preferably slightly longer than the fixed leg so the foot pads 40 do not interfere with each other. In the collapsed mode, the base in convenient to handle, and it occupies a minimum of space for storing and transporting. If desired, a rope or band may be looped around the legs to keep them in the collapsed mode. Alternatively, a pivotable plate with suitable fasteners, not shown, may be used to fasten the two collapsed legs to each other.

The towers 5 of the scaffold system 1 of the present invention may be erected to very high heights. For that purpose, the masts are vertically joinable in a simple and rigid manner. As shown in FIG. 10, a square plug 66 is welded into one end of additional mast sections 68. The plug 66 is received in the interior of the next lower mast to safely hold the two mast sections together. It is preferable that the lowest mast 21 is about twelve feet long and the additional mast sections 68 are about eight feet long. An X-brace 11 is employed with each mast section; fasteners 90 removably join the X-brace to the masts, FIG. 2.

To provide additional lateral support for high towers, a stiffarm 70 connects the towers to the wall 3 by means of a hook 72 engaged in an apertured plate 74 that is anchored in the wall mortar. See FIGS. 1 and 2. Stiffarm 70 is attached to the mast through one of a series of holes 76 that receive a threaded stud 78 fastened to a U-shaped bracket 80. A nut is used to hold the stiffarm on the stud 78. Bracket 80 is held in place on the mast by a fastener 82. Stiffarm supports are normally not required for tower heights of less than twelve feet. The tower may also include several step fixtures 84 secured at desired heights on the mast with fasteners 86. To accommodate the X-brace fasteners 90 and the step fasteners 86, the masts are formed with regularly spaced openings 92.

Any number of towers may be joined longitudinally. The preferred spacing between the towers is about seven feet. To provide equidistant spacing between the towers, spacer rods 9 are employed. The spacer rods fit over threaded studs 88 welded to the base sockets 23; nuts are used to retain the spacer rods on the studs 88.

Bracket

Figure 9:
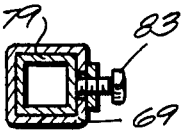
FIG. 9 is an enlarged cross sectional view taken along lines 9—9 of FIG. 1.

Referring to FIGS. 1 and 2, a bracket 7 is guided and supported on each tower 5. In the preferred embodiment, each bracket is manufactured with a main square tubular member 67 that slides over the mast 21. Welded to the main tubular member 67 are laterally extending tubes 69, 71, and 73, together with support members 75 and 77. Tube 69 receives a smaller tube 79 therein, which may have a stop block 81. The sliding tube 79 and tube 69 cooperate to support horizontal planks 13 between adjoining towers and brackets, thereby creating a lower platform 14 for the workmen working on wall 3. The slidable feature of the tube 79 allows the workmen to stand as close to the wall as desired. As shown in FIG. 9, the sliding tube 79 is lockable in the desired location relative to the tube 69 by a locking screw 83.

As best seen in FIG. 1, the tubes 71 and 73 of the bracket 7 support planks 13 to create an upper platform 16 between adjoining brackets. The upper platform is intended for storing materials used by workers standing on the lower platform 14. The preferred elevation of the upper platform above the lower is about 21 inches. The tube 73 slidingly receives a horizontal tube 85 in a manner similar to that previously described with respect to tubes 69 and 79. Tube 85 is lockable relative to the tube 73 by means of a locking screw 87. Joined to the horizontal tube 85, as by a block 89, is a vertical guard post 91. The post 91 includes upper and lower brackets 93 and 95, respectively, for holding horizontal beams 97 and 99, respectively. The beams 97 and 99 extend between adjoining brackets to function as guard rails for the upper platform, FIG. 2. Preferably, the upper and lower guard rails are about 38 inches and 20 inches, respectively, above the upper platform.

To raise and lower the brackets 7 on the towers 5, a conventional electric winch 15 is secured to the bracket main tube 67, as by a pair of brackets 101, FIG. 1. The winch cable 17 is trained around a pulley 19 that is suspended near the top end of the mast 21 from a cap 103 having a hook 104. One end of the winch cable is wrapped around the winch drum 105, and the second end is fixedly secured to the winch frame, as by a pin 107.

A sleeve 109, which may be a square tube with a plate welded to the bottom thereof, is welded to the main tube 67. The sleeve 109 serves to hold a vertical member, not shown, which may be erected to support an over head safety protector or a weather enclosure.

Figure 6:
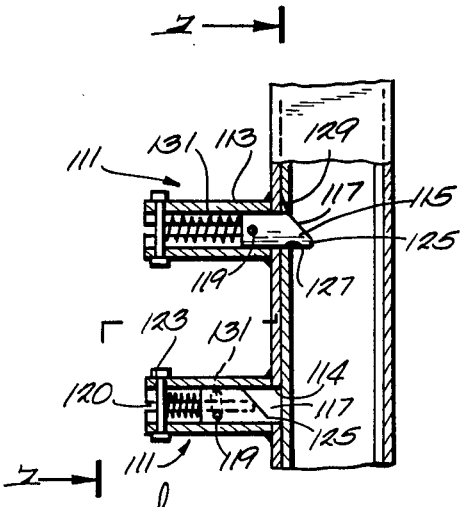
FIG. 6 is an enlarged cross sectional view taken along lines 6—6 of FIG. 2.
Figure 7:
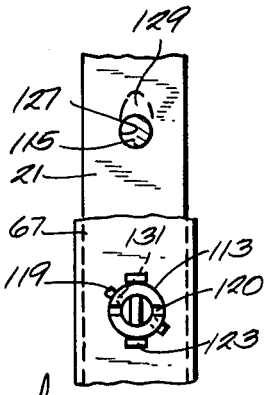
FIG. 7 is a cross sectional view taken along lines 7—7 of FIG. 6.
Figure 5:
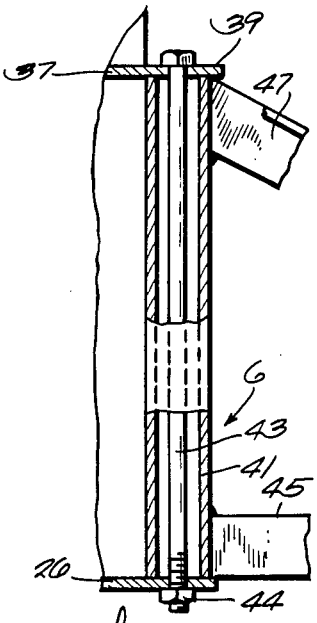
FIG. 5 is an enlarged cross sectional view taken along lines 5—5 of FIG. 3.
Figure 8:
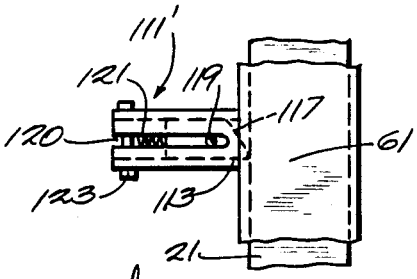
FIG. 8 is an enlarged partial view taken along lines 8—8 of FIG. 2.

Further in accordance with the present invention, the bracket 7 includes a plurality of safety latches 111 and 111' that positively prevent the bracket from falling to the ground if the winch 15 should malfunction or the cable 17 or a related component brake. Referring to FIGS. 1, 6, 7, and 8, each safety latch 111 and 111' comprises a short cylindrical tube 113 welded to the main tube 67 at a right angle thereto. Disposed for reciprocation within the tube 113 and through an aligned opening 114 in the main tube is a cylindrical plunger 115 having a tapered end 117. Extending transversely through each plunger 115 is a handle 119. To permit reciprocation of the plunger with the handle 119, the tubes 113 are formed with longitudinal slots 120 through which the handles project. A spring 121 acting against a screw and nut 123 transversely held near the free end of the tube 113 biases the plunger leading edge 125 against the mast 21. Referring to FIGS. 1, 6, and 7, the mast is formed with a series of openings 127 through one of the walls thereof. As the bracket is raised and lowered on the mast, a plunger enters an opening 127 when a safety latch 111, 111' passes thereover. To aid the plunger to enter the mast openings when the bracket is descending, a tear drop shaped lead-in portion 129 is pressed into the exterior wall of the mast above each opening 127. Thus, if the cable 17 or other related components should break, or if the winch 15 should malfunction, and the bracket thereby fall on the mast, a plunger will enter an opening 127 to stop the fall.

It is a feature of the present invention that the safety latches 111 may be locked to an inoperative condition when the bracket 7 is raised or lowered by the winch 15. Referring to FIGS. 1, 6, and 7, the tube slots 120 of the safety latches 111 are formed with diametrically opposite circumferential notches 131 that are sized to accept the handles 119. By retracting the plunger 115 against spring 121 and rotating the handle and plunger about the plunger longitudinal axis, the handles may engage the notches 131. In that condition, the plungers are locked against reciprocation into a mast opening 127. However, the tube 113 of safety latch 111' is not formed with the notches 131, FIGS. 1 and 8. Consequently, the plunger 115 of safety latch 111' cannot be locked in an inoperative condition. Rather, the plunger of safety 111' must be manually controlled by the winch operator to prevent the plunger from entering a mast opening 127.

In the preferred embodiment of the present invention, the openings 127 are equidistantly spaced at intervals of about 8 inches on the mast. However, the safety latches 111 and 111' are not equidistantly spaced on the bracket main member 67. Rather, as best shown in FIG. 1, the two safety latches 111 are located relatively close together with a preferred spacing between them of about $5\frac{1}{4}$ inches, while the upper safety latch 111' is located about $13\frac{1}{8}$ inches above the upper safety latch 111. With the foregoing dimensions, a plunger 115 is never more than about $2\frac{5}{8}$ inches from an opening 127.

Operation

To use the scaffold system 1 of the present invention, the various components are transported from the storage location to the construction site. One or more mud sills 133 are placed on the ground, if required by site conditions, FIGS. 1 and 2. The collapsed tower bases 6 are placed on the mud sills 133 in an operative mode by swinging the folding legs 29 to the position of FIG. 3, and the cross braces 49 and 51 are fastened to the appropriate base members 45.

The mast 21 and bracket 7 may be assembled to base 6 by any convenient method. For example, a bracket may be laid on the ground and a mast inserted therethrough until a safety plunger 115 engages a mast opening 127. The mast and bracket may be lifted together and the mast and bracket inserted into the base socket 23. The relatively light weight of the tubular components enable one man to raise the mast and bracket. Alternatively, the base may be tipped and the mast inserted into the base socket with the mast approximately horizontal. Then the assembly is raised to an upright attitude. With the mast and bracket in place, the leveling screws 36 are adjusted so that the mast is substantially vertical. Because of the three legged construction of the scaffold system base, the assembled tower is self standing, and the workmen can leave the first tower and proceed with erecting additional towers. The bases are longitudinally spaced by spacer rods 9 placed over the studs 88 of the bases. Steps 84 are erected to the masts at the desired locations. The sliding tubes 79 and 85 are withdrawn the desired amount and locked in place by screws 83 and 87, respectively. Planks 13 are laid across the bracket tubes 69, 71, 73, 79, and 85 to create the platforms 14 and 16. The winch 15 is connected to the brackets 101 and the cap 103 is placed over the top of the mast. Cable 17 is trained over the pulley 19 and secured to the pin 107. Guard rails 97 and 99 are set in place.

When the winch 15 is operable, the bracket height may be adjusted under power. The safety latches 111 may be locked out of position by withdrawing the handles 119 and placing them in the notches 131. Since the safety 111' does not have the notches 131, the winch operator must manually hold the plunger and handle to the disengaged position as the plunger passes over a mast opening 127. The operator releases the handle while the safety latch 111' is between mast openings 127. When the bracket has reached the approximate desired height above the ground, the winch in operated to slightly raise or lower the bracket so that the plunger of one of the safety latches 111 or 111' is insertable into an opening 127. The relative spacings between the openings 127 and safety latches 111 and 111' are such that one of the safety latches is always within $2\frac{5}{8}$ inches of an opening 127. When the bracket is at the final location, the handles 119 of the safety latches 111 are released to the operative mode for service in the unlikely event they should be necessary.

As the height of the wall 3 increases, additional mast sections 68 may be assembled to the mast 21 by means of the plugs 66 on the additional mast sections 68. Stiff-arms 70 and X-braces 11 are used with each additional mast section .

Thus, it is apparent that there has been provided, in accordance with the invention, a scaffold system that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternative, modifications, and variations as fall within the spirit and broad scope of the appended claims.

I claim:

1. A scaffold system comprising:

a. a plurality of towers, each tower comprising:

i. an upstanding mast defining a plurality of equal, vertically spaced openings therein; and ii. a base for vertically receiving the mast, the base having a fixed leg and two legs adapted to swing between an operative mode wherein the two swingable legs cooperate with the fixed leg to support the tower and a collapsed mode wherein the two swingable legs are parallel and adjacent to the fixed leg;

b. a bracket adapted to be guided and supported for vertical movement on each tower, the bracket having a main member defining at least one opening therethrough for communicating with the spaced openings in the mast; and c. safety latch means mounted to each bracket main member for engaging the mast openings to prevent the platform from uncontrolled movement along the tower, and wherein the safety latch means comprises:

d. at least one first tube joined to the bracket main member at right angles thereto over the opening defined in the bracket main member, the tube defining a pair of diametrically opposed longitudinal slots;

e. a plunger having a leading edge disposed in the tube for reciprocation therein and a cam surface facing upwardly to assist in upward adjustment of said scaffold;

f. spring means retained in the tube for biasing the plunger leading edge through the main member opening and against the mast; and g. a handle extending transversely through the plunger and tube slots, so that when the bracket is positioned on the mast with the safety latch plunger aligned with a mast opening the plunger enters the mast opening to prevent movement of the bracket on the mast and wherein said latch includes:

h. a second tube vertically spaced from the first tube at a distance less than the spacing of said plurality of said vertically spaced openings, and joined to the bracket main member at right angles thereto over a second opening therethrough, the second tube defining a pair of diametrically opposite longitudinal slots, each slot having a diametrically opposed circumferential notch;

i. a plunger having a leading edge disposed in the tube for reciprocation therein;

j. spring means retained in the tube for biasing the plunger leading edge through the main member opening and against the mast; and k. a handle extending transversely through the plunger and tube slots, the handle being located at a location aligned with the tube notches when the plunger leading edge is withdrawn from the opening in the bracket main member, so that the plunger may be locked in an inoperative position by engaging the handle in the tube notches to prevent reciprocation of the plunger and thereby prevent the plunger from entering an opening in the mast.

2. The scaffold of claim 1 wherein there are two vertically spaced second tubes with associated plungers, springs, and handles joined to the bracket main member.

3. The scaffold system of claim 2 wherein the spacings between the openings in the mast and the spacings between the first and second tubes are chosen such that a plunger is never more than about $2\frac{5}{8}$ inches from an opening in the mast as the bracket moves along the mast.

4. The scaffold system of claim 2 wherein the two second tubes with associated springs, plungers, and handles are joined to the bracket main member vertically below the first tube.

5. Ihe scaffold system of claim 4 wherein the spacings between the mast openings is about 8 inches, and the spacing between the two second tubes is about $5\frac{1}{4}$ inches, and the spacing between the first tube and the adjacent second tube is about $13\frac{1}{8}$ inches.

6. The scaffold system of claim 1 wherein the mast defines a lead-in above and communicating with the mast openings to facilitate entry of a plunger into the openings.

7. The scaffold system of claim 6 wherein the mast openings lead-ins are formed as tear dropped shaped depressions pressed into the exterior wall of the mast.

8. A scaffold system comprising a plurality of towers, each tower having an upstanding mast defining a plurality of vertically spaced openings therein; and a base for vertically receiving the mast, the base having a fixed leg and two legs adapted to swing between an operative mode wherein the two swingable legs cooperate with the fixed leg to support the tower and a collapsed mode wherein the two swingable legs are parallel and adjacent to the fixed leg, each leg having a horizontal member and an angled brace; a bracket adapted to be guided and supported for vertical movement on each tower, the bracket having a main member defining at least one opening therethrough for communicating with the spaced openings in the mast; and wherein the base further includes a socket for vertically receiving the mast therein, the fixed leg being fastened to and extending radially from the socket; horizontal plate means secured to the socket for pivotally supoorting the swingable legs and wherein the swingable legs include tubes between the ends of the angled brace and horizontal member for supporting the legs between the plate means; said horizontal member and said angle brace of each of said movable legs being welded to said tubes and extending outwardly therefrom to form triangular shaped legs; the plate means include retainer means in the form of bolts extending through said tubes and said plates for pivotally retaining the swingable leg tubes within the plate means, the bolts being located on opposite sides of an imaginary horizontal extension of the fixed leg through the socket;

so that the swingable legs are pivotable about a vertical axis between the operative mode wherein they extend radially from the socket and the collapsed mode wherein they straddle the fixed leg and including braces and means for connecting said braces between said movable legs when said legs are in an operative position and for connecting each end of said braces to the same leg to which it is pivoted when in said storage position.

* * * * *